US008240013B2

(12) United States Patent
Williamson

(10) Patent No.: US 8,240,013 B2
(45) Date of Patent: Aug. 14, 2012

(54) MULTI-FUNCTION CASKET SYSTEM

(76) Inventor: Gerald F. Williamson, Laramie, WY (US)

( * ) Notice: Subject to any disclaimer, the term of this patent is extended or adjusted under 35 U.S.C. 154(b) by 0 days.

(21) Appl. No.: 12/799,473

(22) Filed: Apr. 26, 2010

(65) Prior Publication Data

US 2011/0030181 A1 Feb. 10, 2011

Related U.S. Application Data

(63) Continuation-in-part of application No. 11/824,199, filed on Jun. 30, 2007, now Pat. No. 7,703,186.

(51) Int. Cl.
*A61G 17/00* (2006.01)

(52) U.S. Cl. ..... 27/2; 27/14; 27/19

(58) Field of Classification Search ..... 27/35, 11–13, 27/19, 14, 2; 5/655.3, 706; 220/720, 723
See application file for complete search history.

(56) References Cited

U.S. PATENT DOCUMENTS

| | | | | |
|---|---|---|---|---|
| 2,859,505 | A * | 11/1958 | Jarvis | 5/710 |
| 4,050,125 | A * | 9/1977 | Malbon | 27/2 |
| 5,201,102 | A * | 4/1993 | McClure | 27/12 |
| 5,606,785 | A * | 3/1997 | Shelberg et al. | 27/19 |
| 5,659,932 | A * | 8/1997 | Wright | 27/7 |
| 6,345,422 | B1 * | 2/2002 | Darby | 27/35 |

* cited by examiner

*Primary Examiner* — William L. Miller
(74) *Attorney, Agent, or Firm* — Roland H. Shubert

(57) ABSTRACT

A casket and burial system for human remains includes a casket fabricated from plastics and polymer composites, such as glass-fiber reinforced plastic. The casket includes a base member, a cover member fitting atop the base, and top and bottom closure panels having one or more ports for use in replacing the ambient atmosphere within the sealed casket with a selected gas or fluid such as nitrogen, or to inject a plastic foam into the free space remaining in the casket. The casket is preferably interred in a vertical attitude as that arrangement allows up to four caskets to fit within a standard grave plot.

6 Claims, 10 Drawing Sheets

MULTI-FUNCTION CASKET SYSTEM

REFERENCE TO RELATED APPLICATION

This application is a continuation-in-part of application Ser. No. 11/824,199 that was filed on Jun. 30, 2007 now U.S. Pat. No. 7,703,186.

BACKGROUND OF THE INVENTION

1. Field of the Invention

This invention relates to a casket that is particularly adapted for the upright, or vertical, burial of human remains and to a burial system therefor and for the secure transport of human remains from one location to another.

In particular, this invention relates to a casket that may also serve as the equivalent to the industry-standard Ziegler case for the shipping of human remains. The casket is constructed of plastics, polymers, recycled plastics and polymer composites such as glass-fiber reinforced plastic, and the use where appropriate of specialized polymers and reinforcements, and to modes for its use in the secure transport and burial of human remains. It is preferred that the construction material selected be sufficiently transparent to X-ray that the contents may be inspected without opening the case.

The casket may also be fabricated from materials that are totally biogradable when allowed to remain in the ground for a period of time while displaying the same physical features and structural integrity prior to its being committed to the ground as does a conventional casket.

2. Description of Related Art

Land available for use as cemeteries or burial grounds is becoming increasingly scarce in many urbanized areas of the world. Consequently, that shortage has led to various proposals for more efficient use of available space. Among those proposals are a number that are directed to the upright, or vertical, burial of human remains including, for example, U.S. Pat. No. 3,348,280. That patent discloses a closed tubular burial vault that is installed vertically into the ground so that its upper end is flush with the ground surface. A generally cylindrical casket containing human remains and sized to fit the vault is then lowered into the vault and is sealed therein by means of a lid member that is secured to the upper vault end. Both casket and vault may be constructed of a variety of plastic materials and composites.

Other examples include U.S. Pat. No. 4,328,606 which discloses a burial system having a plurality of vertically disposed and interconnected tubular concrete vaults. An end-opening tubular casket is disposed in each vault, and the vault is then closed by means of fitted covers. A patent to Jalbert, U.S. Pat. No. 3,581,452, describes a burial vault that has a plurality of vertically disposed chambers, each adapted to receive a casket. The vault is sized to fit a normal grave site plot. In another variation, Eubank in U.S. Pat. No. 3,898,718 describes a burial system in which vertical, cased bores are arranged to accommodate as many as three caskets in an end-to-end stacked arrangement, one atop another.

SUMMARY OF THE INVENTION

A first embodiment of the casket and burial system of this invention is provided in which the casket includes a casket base, a casket cover, and top and bottom end closure panels. The casket base and cover are preferably fabricated from appropriate polymers, and also from plastic that is appropriately reinforced with glass fibers as may be the top end closure panels. The lower end closure panels may also be fabricated from reinforced plastic or, optionally from a combination of suitable biodegradable structural solid components. Provision is made for injecting a foam material, either open cell or closed cell, into the casket through one or more ports provided in the closure panels to immobilize the interred body when the casket is oriented vertically for burial. From a functional land-use viewpoint, a vertical burial allows placement of up to four caskets in a burial plot that ordinarily seeks to accommodate a single horizontally placed casket. In many jurisdictions and locales, the need to place a burial casket inside a sealed vault could be negated and thereby further significantly reduce the cost of a funeral—without any untoward effect on concerns that relate to the contamination of the surrounding soils. A casket of this invention that is fabricated from non-biodegradable materials will not cause local subsidence, and subsidence is a primary reason that many cemeteries require a vault. Inundations and subsidence tend to be caused by the degradation of the casket itself, as well as the degradation of the casket contents and, in the use of biodegradable caskets, the area susceptible to subsidence will be localized and far less intrusive that would be the collapse of a full-sized horizontal grave.

A second embodiment of this invention provides a multi-function casket having a casket base and a casket lid which are arranged to join to form a hermetically sealed enclosure suitable for the secure shipment of human remains as well as for burial, either vertically or in a conventional horizontal attitude. The casket lid may be fitted with an extensible bladder that is attached to the underside of the lid and arranged to alleviate pressure buildup within the casket while preventing any leakage of gases from the interior of the casket to the external environment.

DESCRIPTION OF PREFERRED EMBODIMENTS OF THE INVENTION

Figure 1:
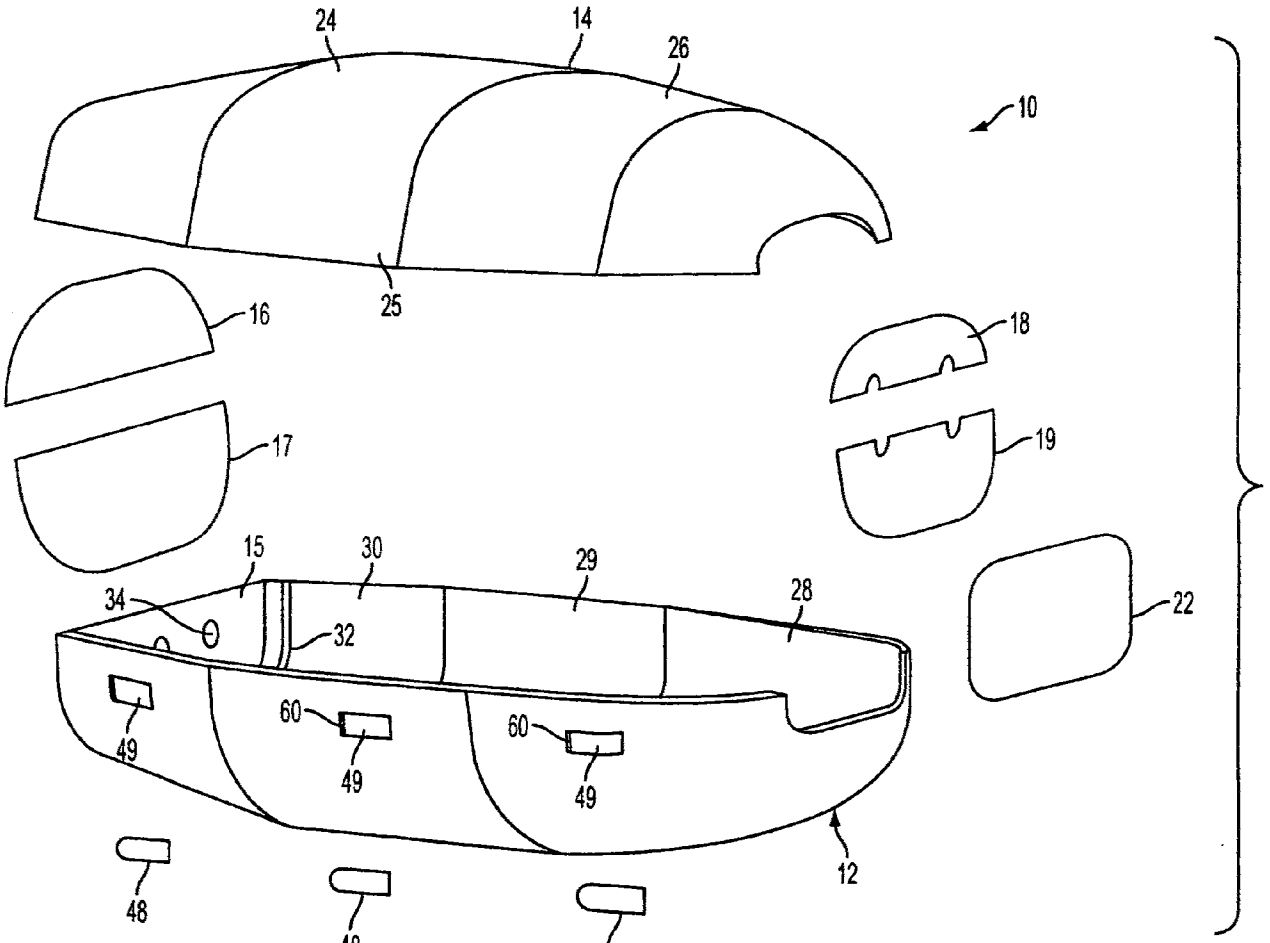
FIG. 1 is an exploded perspective view of the casket system of this invention showing the positioning and relationship of the parts.

Certain preferred embodiments of this invention will be described through reference to the drawings in which FIG. 1 depicts at 10 an exploded view of a first embodiment of the casket and burial system of the invention. Casket assembly 10 includes a casket base 12 and a casket cover 14. The casket is closed at the foot or bottom end by means of closure panels 16 and 17, panel 16 fitting into a channel 34 (FIGS. 4 and 5) provided at the bottom end of the casket cover, and panel 17 fitting into a channel 32 provided at the foot or bottom end of the casket base. Similarly, the top end of the casket is closed by a pair of closure panels 18 and 19, panel 18 fitting into a channel or guide slot 36 (FIGS. 4 and 5) that is provided at the top end of the casket cover, and panel 19 fitting into a channel or guide slot 38 (FIGS. 3 and 4) that is provided at the top end of the casket base. A headstone, or identification marker, 22 may be fitted to the casket end on the exterior side of closure panels 18 and 19 to identify the grave site.

Figure 2:
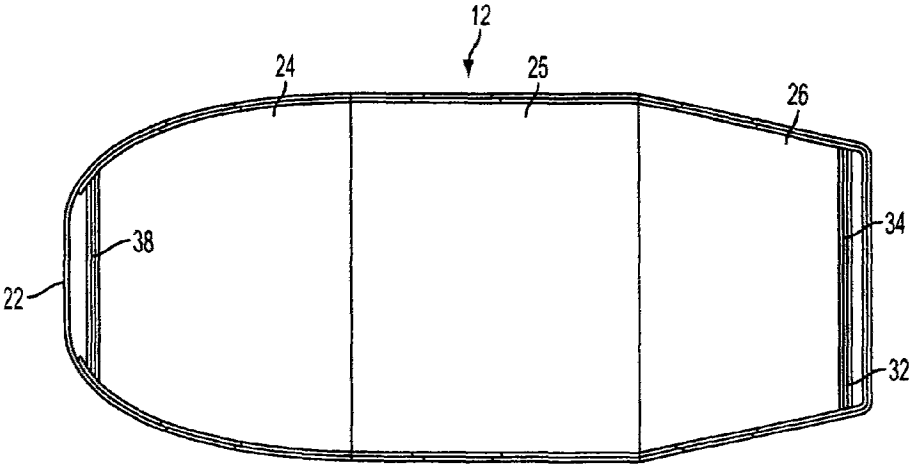
FIG. 2 is a top plan view of the casket base.
Figure 3:
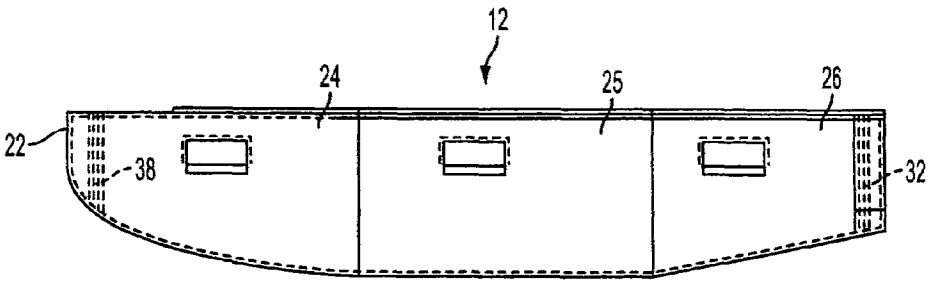
FIG. 3 is a side elevational view of the casket base.

Referring specifically now to FIGS. 2 and 3 in addition to FIG. 1, the casket base 12 is shown in plan view in FIG. 2 and is shown in side elevational view in FIG. 3. In a preferred embodiment, casket base 12 includes an upper section 24, a central section 25 and a lower section 26. The central section 25 may be of regular shape, suitably hemispherical, while both the upper section 24 and the lower section 26 may taper or curve inwardly as is illustrated.

Figure 5:
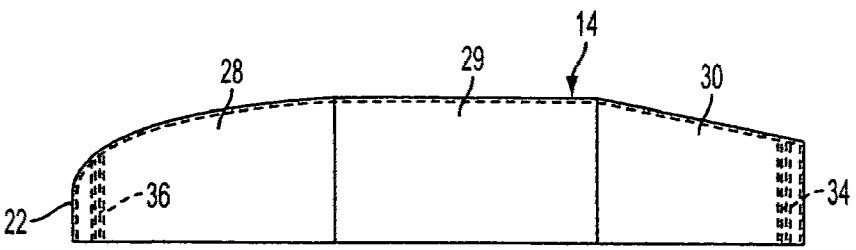
FIG. 5 is a side elevational view of the casket cover.
Figure 4:
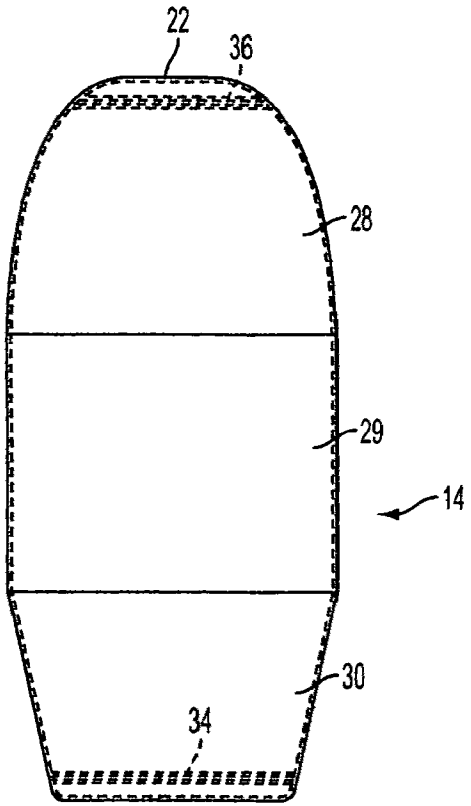
FIG. 4 is a top plan view of the casket cover.

The casket cover 14 shown in FIG. 1 is illustrated in more detail in FIGS. 4 and 5. Cover 14 includes an upper section 28 that conforms in cross sectional shape to base upper section 24, a central section 29 that conforms in cross sectional shape to the base central section 25, and a lower section 30 that conforms in cross sectional shape to the base lower section 26 so that the base 12 and cover 14 fit together to form a generally cylindrical structure that is open at the top and bottom ends. As is shown in the FIG. 1 exploded view, the bottom end of the casket base is closed by one or more panels 15, 17 that fit within one or more corresponding channels 32 which are provided at the interior end of the casket base. Similarly, the top end of the casket base is closed by one or more panels 19 that fit within one or more corresponding channels 38 which are provided at the head end of the casket base.

Figure 8:
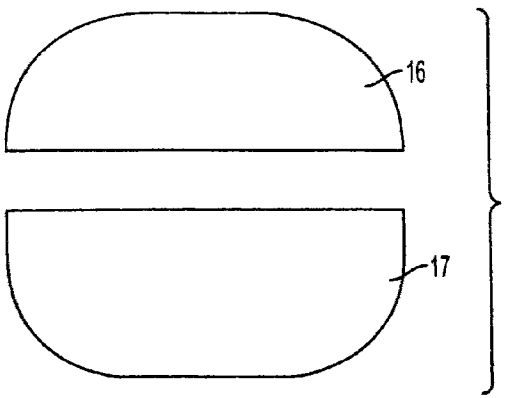
FIG. 8 is a plan view of a two-piece closure panel for the casket ends.
Figure 6:
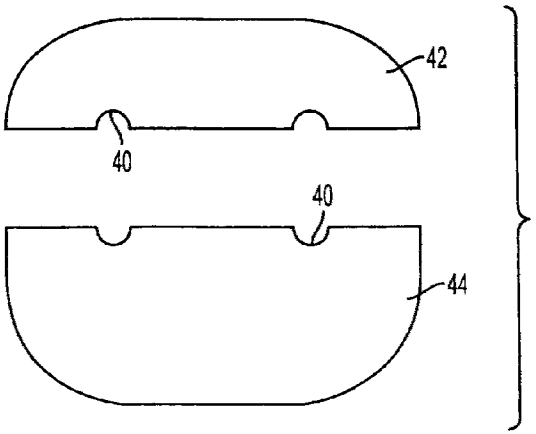
FIG. 6 is a plan view of a two-piece injection panel that forms a closure for the casket ends.

As is illustrated in FIGS. 6 and 8, as well as in FIG. 1, the closure panels are generally planar and may be either solid as are panels 16 and 17 or may be provided with one or more ports 34 as with panel 15. Ports 34 may be wholly bounded by the panel member as are those of panel 15 or may be formed by matching hemispherical cut-outs 40 in the casket cover panel 42 and its mating casket base panel 44.

Figure 7:
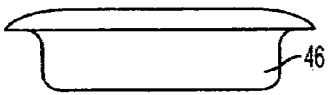
FIG. 7 is a side elevational view of a plug member arranged to seal the injection panel after foam injection.

The ports may serve a number of different functions. In some instances, for example, it is desired that decay of the interred body be retarded to the greatest extent possible and, in that instance, ports 34 may be used to replace the ambient atmosphere within the casket with an inert gas such as nitrogen or argon or other decay inhibiting gas or mixture of gases. In another function, ports 34 serve as an injection point for a plastic foam. Any of the commonly used packaging, open or closed cell foams including, for example, expanded polyurethane, polystyrene and polyolefin foams may be used for this purpose. The injected foam sets to a rigid state to create support means for the interred body when the casket is placed in a vertical position. After port use is complete, each port is sealed by insertion of a plug member therein. A plug member 46 suitable for this purpose is illustrated in FIG. 7.

Figure 9:
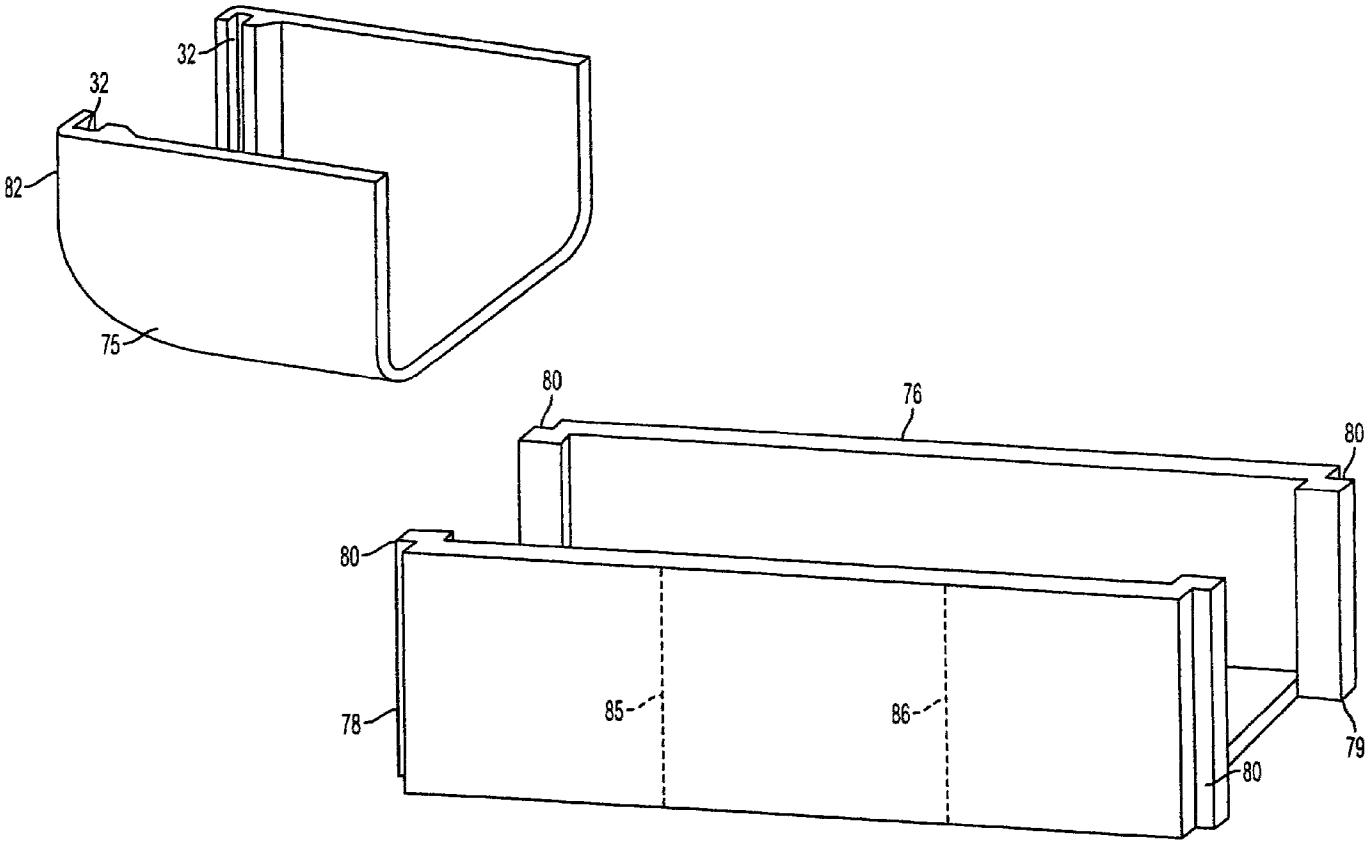
FIG. 9 illustrates an alternative embodiment of the casket base and cover.

The casket of this invention has been described as having a base and a cover that are sized and fabricated to fit together to form a generally cylindrical unit. Fabrication of the casket base and cover requires a mold for each. In the event that more than one size of casket is needed, then a separate mold set is required for each casket size. FIG. 9 illustrates a structural arrangement that is preferred in those instances wherein a range of casket lengths and sizes is desired. In this embodiment, both the casket base and casket cover includes three component parts; a lower foot section, a center section, and an upper head section. FIG. 9 shows the foot section 75 and the center section 76 of a casket base in which the center section ends 78 and 79 match the profile of the foot section 75 and of the head section (not shown.) The terminal end 82 of foot section 75 is identical in form and function to the foot end of the unitary casket base shown in FIGS. 1-3, having a channel or guide slot 32 for placement of a closure panel 17. Likewise, the terminal end of the head section (not shown) is identical in form and function to the head end of the unitary casket base shown in FIGS. 1-3.

Center section 76 is arranged to be fabricated in several different lengths; for example, from end 78 to first termination point 85, or to second termination point 86, or to the section end 79. No matter the length of center section 76, both the head and the foot section will remain unchanged, matching the profile of the center section ends. A head, center, and foot section must be joined in order to obtain a complete casket base or cover. Center section ends 78 and 79 incorporate an offset flange 80 that is arranged to fit over and overlap with the inside surface of the head and foot sections. Jointure of the sections, one to another, is preferably accomplished by applying a bonding agent, or adhesive, to the surface of the offset flange 80 so that a bond is formed between the flange surface and the interior surface of the foot and head sections. Mechanical fasteners, such as screws and the like, may be used instead of or in addition to adhesives and bonding agents.

Sectional construction of the casket base and cover also allows for convenient fabrication of caskets designed to accommodate unusually large cadavers. Most humans that are very large in dimension concentrate the maximum size and girth through the central part of the body while the head and foot areas are much more closely normal size. Those special needs may then be accommodated by providing an outwardly bowed shape to the central section, leaving the foot and head sections unchanged in size and shape. Also, sectional construction of the casket cover allows a part or all, but typically the head section, of the casket cover to be fabricated of a transparent, or at least semi-transparent, structural polymer such as polycarbonates.

In one preferred embodiment that is illustrated generally in FIG. 1, a plurality of detachable handles 48 are provided for removable attachment to the casket base at receptacles 49 at spaced locations thereon. Handle 48 is shown in perspective view in FIG. 10. It includes a lifting rail 51 held between a pair of bracket members 53, 54 extending outwardly from a base member 56. Ears 58 extend from the ends of base 56 to slide into and be retained by channels 60 that are provided at the sides of receptacles 49. The handles may be fitted in place on the casket base for convenient lifting and carrying of the casket by attendants or pall bearers.

Figure 11:
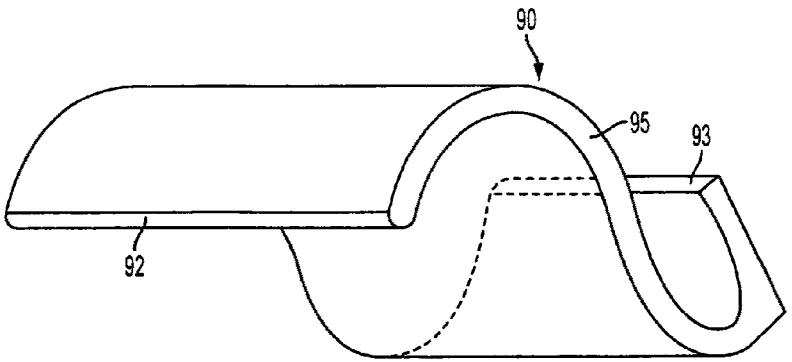
FIG. 11 depicts an alternative embodiment of the handle that is illustrated in FIG. 10.

An alternative, and in some cases preferred, handle embodiment 90 that may be used with casket bases of either unitary or sectional construction is illustrated in FIG. 11. In this embodiment, handle 90 is preferably of one-piece construction having an outwardly extending, lifting portion 92 and an upwardly directed, casket-engaging wedge attachment portion 93. The lifting or gripping part of the handle 92 is connected to the attachment area 93 through a continuous structural web 95. Handle 90 may be constructed of any material, such as structural plastics and cast metals that is capable of withstanding the loads placed upon it.

Figure 14:
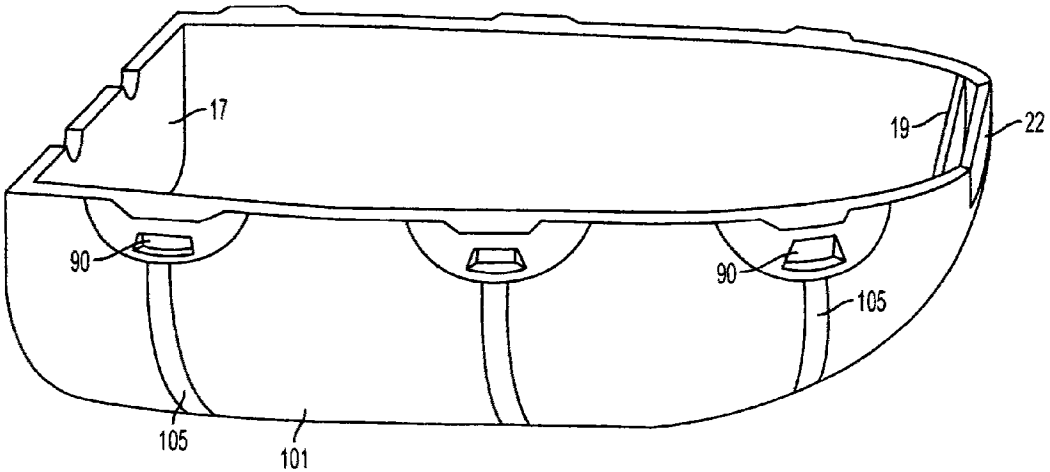
FIG. 14 shows a plurality of handle pairs as employed with the casket system of this invention.
Figure 12:
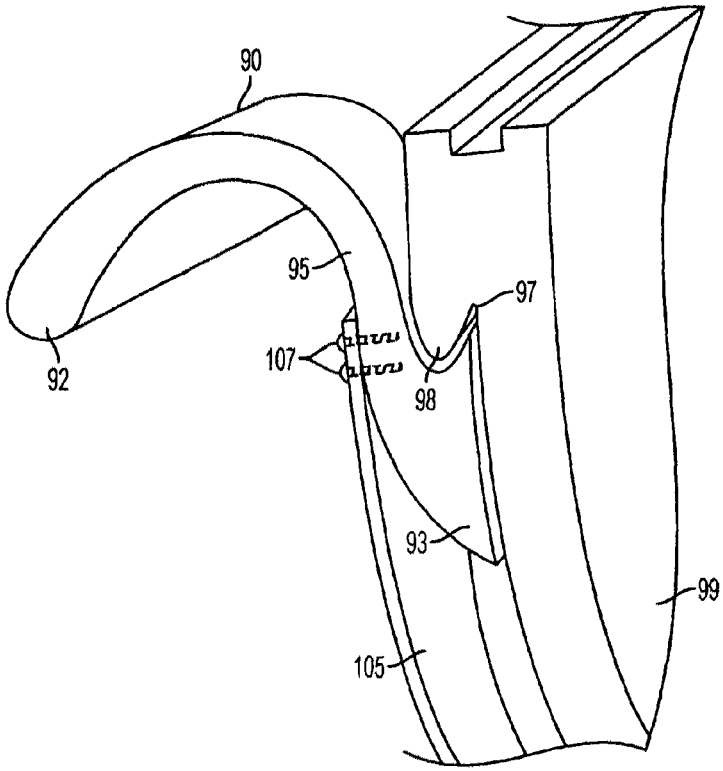
FIG. 12 is a partial sectional view showing details of the manner in which the handles of FIG. 11 attach to the casket base.
Figure 13:
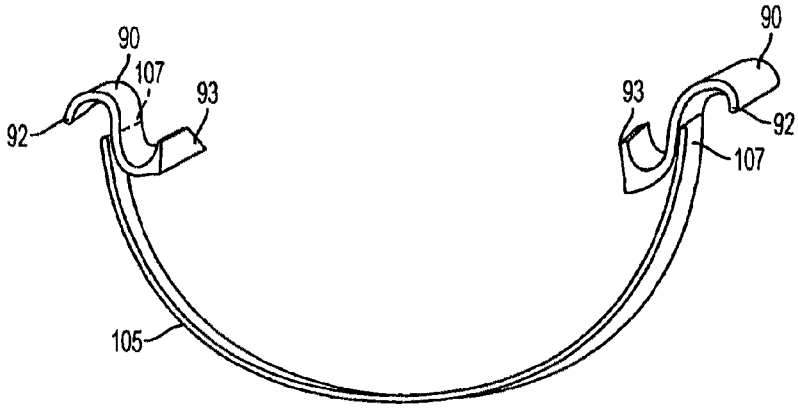
FIG. 13 illustrates the manner in which a pair of handles is arranged for use.

Turning now to FIGS. 12-14 in addition to FIG. 11, FIG. 12 comprises a partial cross-sectional view showing handle 90 in engaged position with a lifting well 97 that is defined by a downwardly projecting lip 98 formed from the wall portion 99 of a casket base 101. Casket base 101 may be of unitary construction as illustrated in FIGS. 1-3, or may be of sectional construction as is depicted in FIG. 9. Wedge attachment portion 93 extends into and engages with lifting well 97 to thus provide a detachable lifting means to move the casket from place to place. It is clear by reference to FIG. 12 that a lifting force applied to the gripping area 92 of handle 90 will produce a large twisting or bending moment to casket side wall 98. It is possible to negate the effect of such a bending moment by thickening or otherwise reinforcing the area of casket wall 98 that is adjacent to the handle attachment locations. It is preferred, however, to form the handles in pairs as is best illustrated in FIG. 13. Each end of a length of flexible strapping 105 is connected to a handle 90 at a location, best shown in FIG. 12, where it does not interfere with the meshing of wedge attachment portion 93 and lifting well 97. Strapping 105 may conveniently be secured to handle 90 using screws or rivets 107 or other suitable mechanical connectors. The length of strapping means 105 is adjusted such that essentially the total load of the casket and its contents is borne by the strapping means when a lifting force is applied to a handle pair in place within the lifting wells on opposite casket sides. A minimum of two handle pairs is ordinarily required for convenient lifting and movement of even the smallest of caskets. Ordinarily, a casket will be provided with three handle pairs as is illustrated in FIG. 14, but four or even five handle pairs can appropriately be provided for use with large and heavy caskets. Depending upon the placement of the handle pairs along the casket and upon the casket profile, the strapping members 105 of the various handle pairs may need to be of slightly different lengths.

Figure 10:
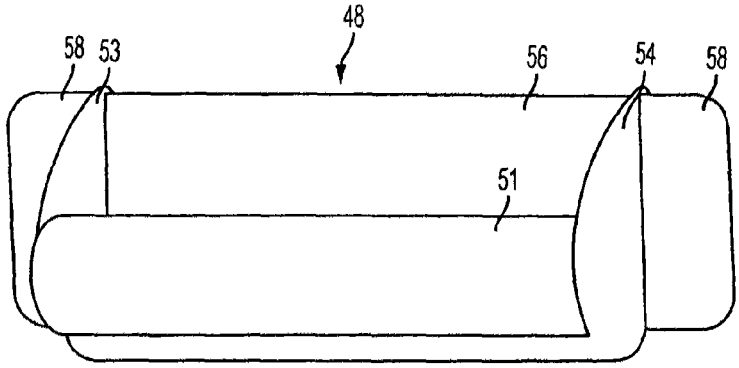
FIG. 10 is a perspective view of a removable handle that is attachable to the casket base.
Figure 15:
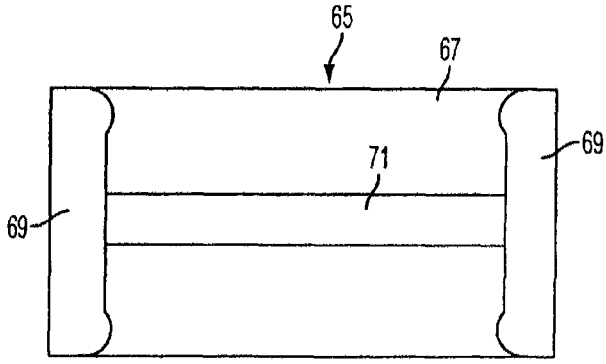
FIG. 15 is a top plan view of a strap tie.
Figure 16:
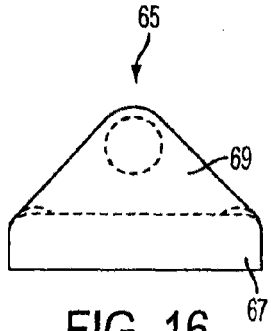
FIG. 16 is an end elevational view of the strap tie of FIG. 15.
Figure 17:
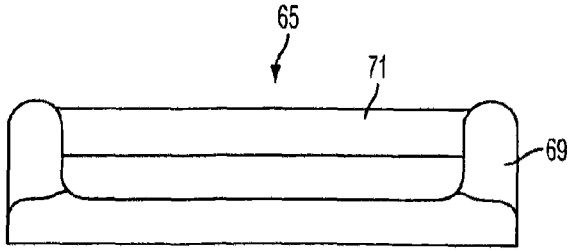
FIG. 17 is a side elevational view of the strap tie of FIG. 15.

A plurality of strap holders 65, illustrated in FIGS. 10, 11, and 12, are fixed to the inside surface of the casket base at locations preferably opposite to the exterior locations of handles 48. A strap holder 65 is shown in top plan view in FIG. 10, in end elevational view in FIG. 11, and in side elevational view in FIG. 12. Referring now to those Figures, strap tie 65 includes a bottom member 67 having a pair of bracket members 69 protruding outwardly therefrom. A tie bar 71 extends between and is fixed to the bracket members 69 to provide an anchoring means for the strapping. The strap holders serve to provide anchor points for the attachment of restraining means such as strapping (not shown) that provide support for the cadaver before and in addition to the foam that is injected into the cavity of the closed casket. Placement of the straps at the locations described ensures that the head, torso, and hips of the remains will be held in correct anatomical relationship when the casket is placed in an upright position even after decomposition or preservation of the remains has taken place. Other types of fastening systems, such as VELCRO®, may also be used for this purpose.

It is preferred that the casket base 12 and casket cover 14 be fabricated from glass fiber reinforced plastic, which is a composite material made up of short strands of fine glass fibers dispersed through a plastic matrix. The plastic matrix may comprise any of the polymers or resins that are commonly used for this purpose including, for example, polyesters, vinylesters, and epoxies as well as any suitable recycled materials. The casket parts may be fabricated, for example, by placing a chopped strand mat of glass fibers in a mold, coating the mat with resin, and then letting it cure. Other manufacturing techniques, including resin transfer, hand lay-up, injection molding, hot or cold forming, or any other technique that is appropriate for use to fabricate components and parts for multi-part structures or composite products may also be employed. Casket cover 14 may also be fabricated entirely from a transparent material to allow viewing.

Any desired finish may then be applied to the casket surfaces. The outer surfaces of the entire unit may be finished with an essentially infinite variety of finishes, textures, paintings, powder-coatings, colors, and other special treatments that render a casket reflectively unique to the person being honored.

In those instances where it is sought to preserve the interred body, the casket end closure panels 15, 16, 17, 18, and 19 are preferably fabricated from reinforced plastic as with the casket base and cover. The various casket parts are permanently joined using a bonding adhesive, including super-glues and other permanent adhesives, which are placed on the edges of the closure panels and on the edges of the casket top and bottom. The casket parts are then immobilized for a time sufficient for the adhesive to set up. Immobilization of the casket parts while the bonding agent is curing may conveniently be obtained by placement of a band of a heat-shrinkable material around the periphery of the casket at the juncture of the casket base and cover to form a collar. Application of heat, using a heat gun for example, causes the collar to shrink and secure the base to the cover. Alternatively, a metal edge binder that is sized to fit the particular casket may be placed around the casket periphery and thereafter tightened using springs and lever means. After the adhesive has cured, the atmosphere within the casket may be replaced with gases or fluids chosen to preserve the contents or a foam may be injected. The ports 34 are then sealed to ensure that the closed casket is fluid-tight and that there is no seepage or contamination. The casket end closure panels may also be utilized for attachment of accessories, such as pressure gages and sampling ports, to test or confirm the condition of the casket interior after the injection of liquids or gases into the casket for preservation purposes and the like.

In other instances it may be desired to allow or even to accelerate the natural processes of decay and integration back to the earth. In those instances, the casket bottom end closure panels 15, 16 and 17, are fabricated from a biodegradable material that disintegrates upon prolonged contact with soil and moisture. If desired, the injected foam may also be modified in composition to include a biodegrading accelerator or enhancer such as an enzyme or the like to allow more rapid assimilation with the soil.

The casket 10 of this invention also may be interred in a horizontal attitude as is the conventional burial practice. However, most advantage will be gained by interring the casket in a vertical orientation. When interred vertically in this fashion, four caskets may fit in the standard grave plot instead of the single casket that is now allocated for that same space. That space saving is becoming increasingly important in the urban areas of the world as land is commanding an increasing premium. It is also a reality that the air borne particulate and gaseous contaminants from cremation are starting to cause serious concern to areas where the air quality is already seriously challenged by emissions from other pollutant sources. Vertical interment also simplifies and substantially reduces the cost for excavating the grave for placement of the casket. In most instances, the grave can be excavated using an auger drill to bore a hole slightly larger in diameter that is the diameter of the casket with a depth equal to the casket length.

It is a reality of the social evolution that has been and is taking place in the funeral services industry that there is a growing demand for individualization or customization of furnishings such as caskets. There is also recognition of the fact that cremation of a body consumes a substantial quantity of fuel as well as releasing significant quantities of particulate matter to the atmosphere. The use of a polymer casket as described herein allows for the providers of funeral services to offer almost unlimited choices of colors, textures, and other customized treatments for the outside surfaces of the casket and for the casket interior as well. Further, the optional use of specific operational characteristics of the plastics used in casket fabrication allows the funeral services provider to respond to the particular requests of the service seeker. It is also of note that in those instances in which a non-degradable casket is chosen that will allow the remains to revert to the earth, there will be no collapse or subsidence of the interment area. The casket itself will retain its structural integrity and no surface disturbance will occur. Where a biodegradable system is used, the resulting subsidence will be notably less difficult to manage than is the case with a traditional, horizontal interment.

Figure 18:
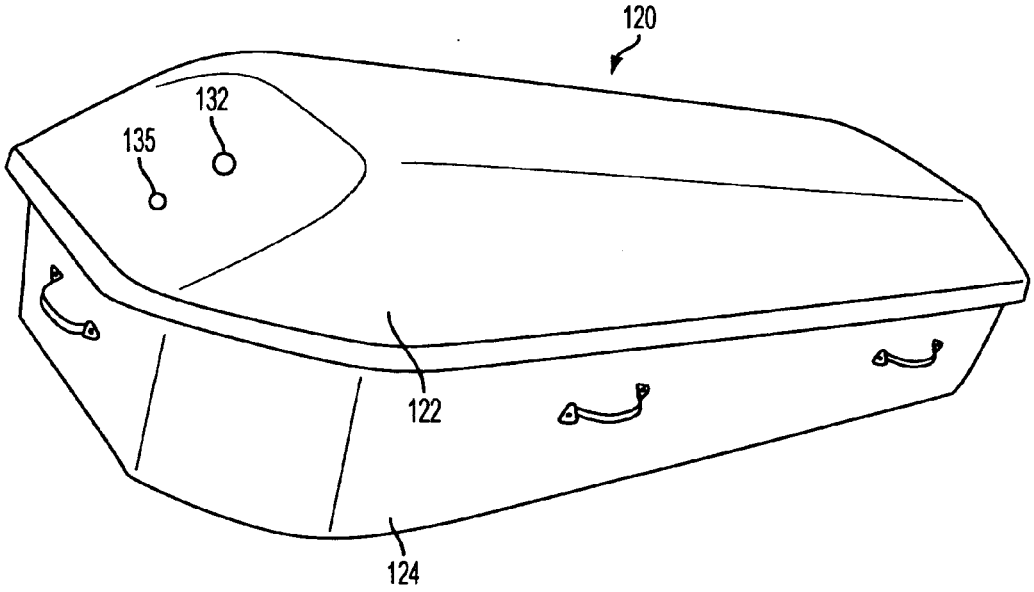
FIG. 18 is a perspective view of a different and multi-function embodiment of the casket of this invention that is suitable for both secure transport and for burial.

Turning now to a second embodiment of this invention which is illustrated generally at 120 of FIG. 18 and which comprises an oblique view of a multi-function casket constructed in accordance with the teachings of this invention. The casket 120 includes a casket lid 122 and a casket base 124 which are attached one to the other so as to form a hermetically sealed enclosure. As with the FIG. 1 and FIG. 9 embodiment, the casket base and top may be constructed of component parts in which the length of a central component may be varied so as to provide different casket sizes. The casket, and in particular the casket base, are dimensioned so that that the casket base can be employed as a casket liner for a rental, or display, casket. A rental casket is a specifically made, decorative wood casket that allows the user to place a removable interior repository or liner in the base of the decorative casket for display purposes. Once the ceremony is finished, the liner and its contents are removed from the decorative display casket and the liner then is used as a simple container, frequently for subsequent cremation. In contrast, the casket base 124 after removal from the display casket is paired with lid unit 122 which then may be used as a structural burial unit. Use as a structural burial unit requires that casket 120 have sufficient physical strength as to be buried without the additional requirement for a vault to prevent later subsidence.

The transport of human remains, particularly unembalmed human remains, requires a secure container that completely contains odors and has sufficient strength to withstand air and surface carrier freight handling without damage. It is preferred that the construction material selected for the container be sufficiently transparent to X-ray that the contents may be inspected without opening the case. Such transport routinely employs the industry-standard Ziegler case which is a sealed metal container sized and shaped to accommodate a cadaver. The container is then often packed within a crate which is secured to a pallet, thus allowing movement of the Ziegler case by means of a fork lift. Transport of unembalmed remains is necessary in cases where an autopsy or other tissue testing is to be performed at the destination location or to honor religious tradition. For example, Jewish tradition prohibits embalming of their dead which then poses problems of containing odors while at the same time honoring tradition. Other problems arise at the destination location in the transfer of the remains from the Ziegler case to the final casket. Also, some jurisdictions require that the Ziegler case be treated as biohazardous waste after use and destroyed, sanitized, or otherwise safely disposed of at the destination location. The casket system of this invention mitigates those problems as it can be used first for the secure transport of human remains, later for ceremonial display in a rental casket, and thereafter for the direct burial of the remains without need for a vault.

Figure 19:
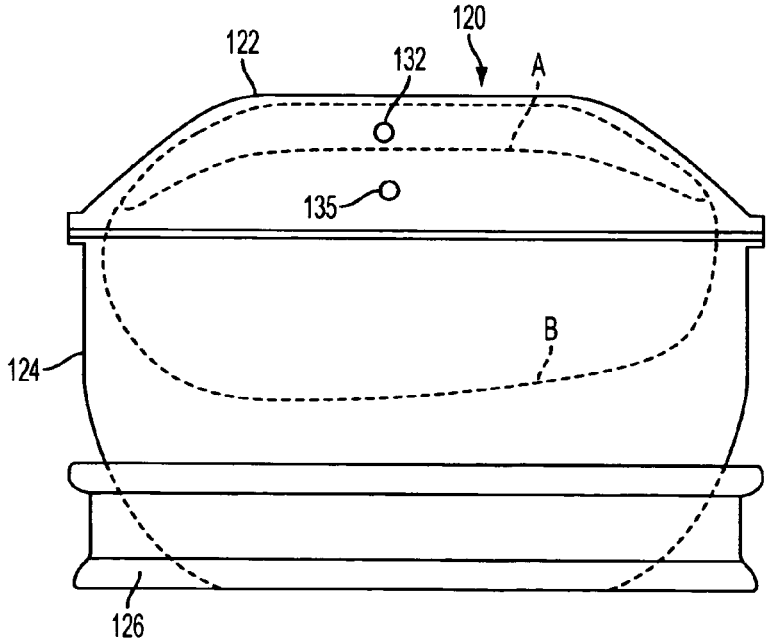
FIG. 19 is a frontal end view of the casket of FIG. 18 with an added base skirt or platform unit and including an internal pressure controlling bladder.
Figure 20:
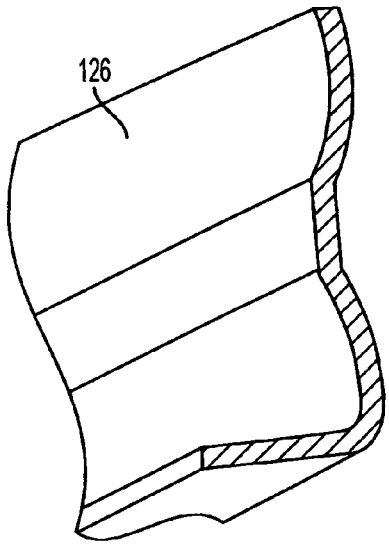
FIG. 20 is an oblique sectional view of a base skirt shown generally in FIG. 19.

Referring now to FIGS. 19 and 20, there is shown at FIG. 19 a frontal end view of the casket of FIG. 18 with an added base skirt or display platform 126 and an internal extensible bladder 130. Base skirt 126 is shown in cross-sectional view in FIG. 20. Skirt 126 serves two purposes, one utilitarian and the other decorative. Pall bearers in traditional burial ceremonies find the generally curved profile of the casket base 124 to be uncomfortable and difficult to securely grasp and carry. The base skirt restores the traditional casket profile and feel to the casket base as well as providing a more traditional visual appearance to the casket system. The skirt 126 is of uniform cross section as is shown in FIG. 20 and thus can be produced as a simple plastic extrusion which then is assembled as a rectangular unit which is sized to allow the casket base 124 to nest within the skirt and to be secured thereto by means of adhesive or other appropriated technique.

There are circumstances where it becomes highly desirable and even necessary to relieve the pressure of gases trapped inside a sealed casket without the gases escaping into the atmosphere. Such circumstances can arise when a casket is left in the sun for an extended period of time so that the air and other gases trapped within the sealed casket expand; or if a sealed casket is placed in the hold of an unpressurized airplane; or if a preservative chemical or other material has been injected into the casket to preserve the contents. As is shown in FIG. 19, gas pressure buildup within casket 120 is relieved by means of an extensible bladder 130 bonded to the inside top of the casket lid 122. Bladder 130 preferably extends the length and width of the casket lid and, when expanded, encompasses essentially all of the free space within casket 120. Gas communication between the atmosphere and the bladder interior is established through a first valved port 132 which is arranged to allow the bladder interior to be filled with air or other inert pressurizing gas so as to expand the bladder from its empty position, shown as reference designation "A", to its extended position shown as reference designation "B".

In preparation for transport, a casket 120 containing human remains is closed and sealed with the bladder 130 in its empty, or "A", position. A second valved port 135 is arranged to control gas communication from the interior of the casket, and external to the bladder, to the atmosphere. Port 135 is placed in its open position allowing gas to flow from the interior of the casket to the atmosphere while valved port 132 is connected to a pressurized source of air or other inert gas (not shown) and is positioned to allow gas to flow from the source to the bladder interior. The pressurized air source may be a simple hand pump or bellows, or may be a pressurized gas reservoir. As the bladder expands, air is forced from the casket interior through port 135 to the atmosphere. When the bladder is fully extended, port 135 is sealed in a closed position and port 132 is disconnected from the external pressurized gas source. Port 132 is then arranged to function as a pressure relief valve, allowing gas to exit the bladder when the pressure within the bladder reaches a preset level. Pressure that builds up within the casket external to the bladder thus is relieved as the bladder volume decreases.

Figure 21:
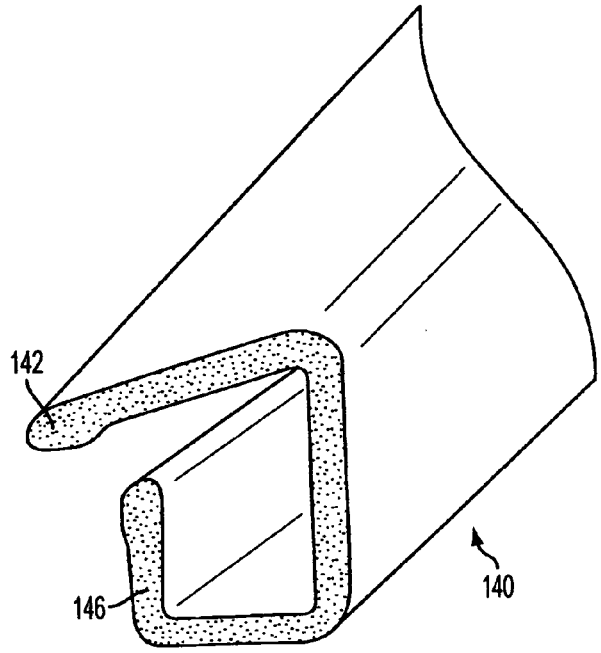
FIG. 21 is an oblique end view of a clip for securing the casket top to the casket base.
Figure 22:
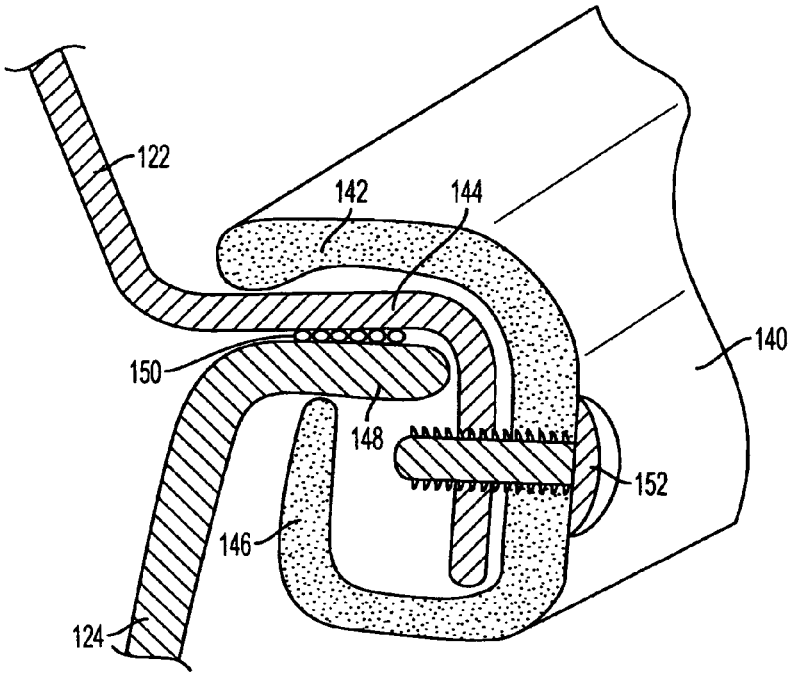
FIG. 22 is a cross-sectional view of the clip of FIG. 20 as it is used to secure the casket top to the casket base.

The casket lid 122 is ordinarily adhesively joined to the casket base 124. In some circumstances of use or when a gasket is used to seal the casket top to the casket bottom, it is desirable that the casket top and casket base be mechanically locked together so as to allow opening of the casket. A preferred clip means for locking the casket top to the casket bottom is illustrated in FIGS. 21 and 22. FIG. 21 is an oblique end view of a plastic clip 140 for securing the casket top to the casket base while FIG. 22 of the clip 140 of FIG. 21 as it is used to secure the casket top to the casket base. Clip 140 is of uniform cross-section, preferably constructed of a plastic extrusion, of a generally reverse C shape, and having an upper extending lip 142 which fits over rim 144 of casket top 122 while a second vertical lip 146 exerts pressure upon rim 148 of the casket base. A sealing material 150 is placed between casket top rim 144 and casket base rim 148. Sealing material 150 may be an adhesive if a permanent seal is desired or may be appropriate gasketing material if re-opening of the casket is needed. Clip 140 may be securely attached to the casket through fasteners 152 inserted through holes drilled through the clip and casket top rim as is shown.

Other modifications and variations will be evident to those of ordinary skill in the art without departing from the spirit and scope of the described invention.

I claim:

1. A casket adapted for the secure transport of human remains comprising:

a casket top and a casket base arranged to be joined together to form a hermetically sealed container for holding said remains;

a bladder attached to the underside of said casket top;

a first valve means in said casket top placing said bladder interior in fluid communication with the atmosphere, said first valve means allowing expansion of said bladder from an empty position to an extended position; and a second valve means in said casket top controlling the flow of gas from the casket interior to the atmosphere.

2. The casket of claim 1 wherein said casket top and casket base are constructed of a biodegradable material.

3. The casket of claim 1 wherein said casket top and casket base are constructed of a polymeric material.

4. The casket of claim 3 wherein said polymeric material is a glass fiber reinforced plastic.

5. The casket of claim 1 wherein said casket top and casket base are transparent to X-Ray.

6. The casket of claim 1 wherein said casket top and casket base are adhesively joined to form a sealed container.

* * * * *